US005803267A

United States Patent [19]

Tu et al.

[11] Patent Number: 5,803,267

[45] Date of Patent: Sep. 8, 1998

[54] STRUCTURAL IMPROVEMENT ON KEYBOARD PACKAGING BOX

[75] Inventors: Jung-Pin Tu; Tao-Kuan Chen, both of Taipei, Taiwan

[73] Assignee: Chicony Electronics Co., Ltd.

[21] Appl. No.: 902,041

[22] Filed: Jul. 29, 1997

[51] Int. Cl.[6] ..... B65D 85/30

[52] U.S. Cl. ..... 206/576; 206/723; 206/591; 206/586

[58] Field of Search ..... 206/314, 14, 723, 206/521, 586, 587, 591, 592, 594, 784, 576

[56] References Cited

U.S. PATENT DOCUMENTS 3,095,086 6/1963 Berg ..... 206/784
4,126,222 11/1978 Aust ..... 206/314

*Primary Examiner*—Jacob K. Ackun
*Attorney, Agent, or Firm*—Rosenberg, Klein & Bilker

[57] ABSTRACT

The subject invention relates to a type of structural improvement on keyboard packaging box, said keyboard packaging box comprising an integral cardboard that is cut, folded and assembled; including a bottom box and a top; the bottom box comprising of a bottom, front plate, rear plate and two sides; the side being composed of a first side plate, a second side plate and inner plates; the front plate being adjoined to a separating plate; said separating plate located in the middle part of the bottom box and gradually inclines upward; the keyboard and the armrest can be accommodated respectively below and above the separating plate; the connecting wire of the keyboard can be accommodated in the accommodating chamber formed by one side of the separating plate; by so design to achieve such effects as increased structural strength and better protection of the keyboard.

2 Claims, 7 Drawing Sheets

STRUCTURAL IMPROVEMENT ON KEYBOARD PACKAGING BOX

BACKGROUND OF THE INVENTION

The subject invention relates to a type of structural improvement on keyboard packaging box, particularly to one type of keyboard packaging box structure with increased structural strength, better tensile strength, and better protection of the keyboard.

DESCRIPTION OF PRIOR ART

Conventionally, a prior art of keyboard packaging box is mainly designed to facilitate handling and prevent any damage done to the keyboard product because of unavoidable impact during transportation. There are several type of conventional keyboard packaging boxes available on the current market. Such as the prior art of keyboard packaging box disclosed in domestic Patent Gazette Serial No. 262026 "Improvement on Keyboard Packaging Box", as illustrated in FIG. 1; said keyboard packaging box is made of a single sheet of cardboard that is cut, folded and assembled, comprising a bottom box 10*a;* in the middle of the bottom box 10*a* is a bottom 11*a;* to the opposite short ends of the bottom 11*a* are adjoined two sides 12*a;* while to its long ends are respectively adjoined a front plate 13*a* and a rear plate 14*a;* one side of the rear plate 14*a* extending to form a top 15*a;* the other side of the top 15*a* continues to extend to form a front edge 16*a;* at the middle of the other side of the front edge 16*a* and at its two ends are respectively an insert 17*a* and wings 18*a* that are designed to be inserted to the bottom box 10*a,* to compose a sealed-type of keyboard packaging box; while the keyboard may be positioned inside the bottom box 10*a* to facilitate handling.

However, the integral structural strength of said prior art of keyboard packaging box is relatively weak, and its tensile strength is also poor; in many cases, it would not be able to satisfactorily achieve

SUMMARY OF THE INVENTION

The purpose of the subject invention is to

To enable better and full understanding, the technical approaches and effects employed in the subject invention to achieve the above purpose and configuration are described in details below with drawings of preferred embodiment:

BRIEF DESCRIPTION OF NUMERALS

| | | |
|---|---|---|
| 10 bottom plate | 11 first side plate | 12 second side plate |
| 13 side insert | 14 side insert groove | 15 front plate |
| 16 rear plate | 17 top | 18 front edge |
| 19 top insert | 20 wing | 21 top insert groove |
| 22 bottom insert groove | 23 bottom insert | 24 inner side plate |
| 25 inner side plate | 26 separating plate | 27 partition line |
| 28 penetrated hole | 29 folding line | 30 partition line |
| 31 folding line | 32 vertical plate | 33 first long plate |
| 34 second long plate | 35 third long plate | 36 fourth long plate |
| 37 rear insert | 38 rear insert groove | 39 line pulling hole |
| 40 positioning plate | 41 folding line | 42 partition line |
| 43 positioning plate | 44 folding line | 45 partition line |
| 46 side | 47 bottom | 48 accommodating chamber |
| 49 keyboard | 50 armrest | 51 connecting line |
| 10a bottom box | 11a bottom plate | 12a side |
| 13a front plate | 14a rear plate | 15a top |
| 16a front edge | 17a insert | 18a wing |

DETAILED DESCRIPTION OF PREFERRED EMBODIMENT

Figure 1:
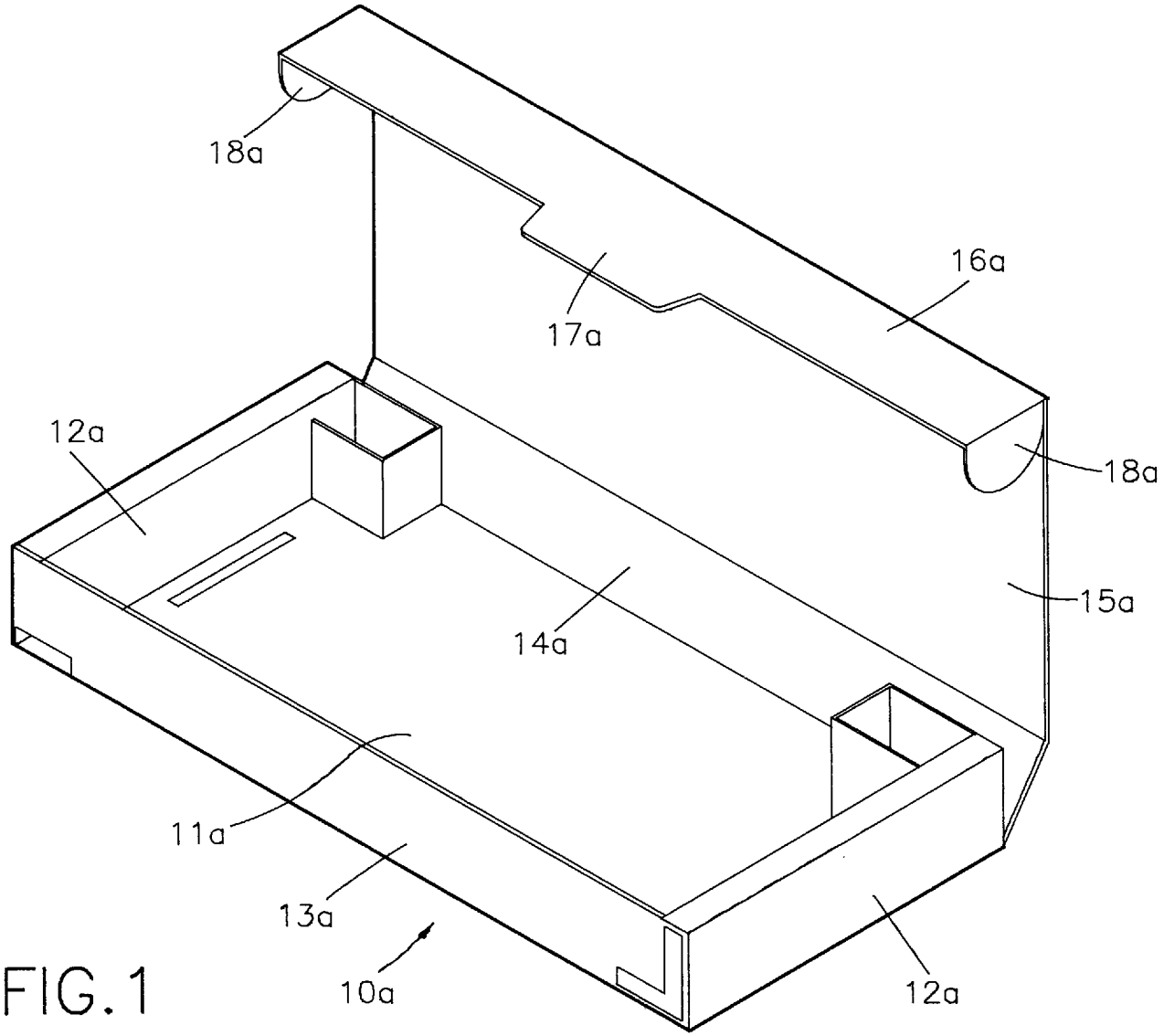
FIG. 1 is the perspective view of a prior art of keyboard box.
Figure 2:
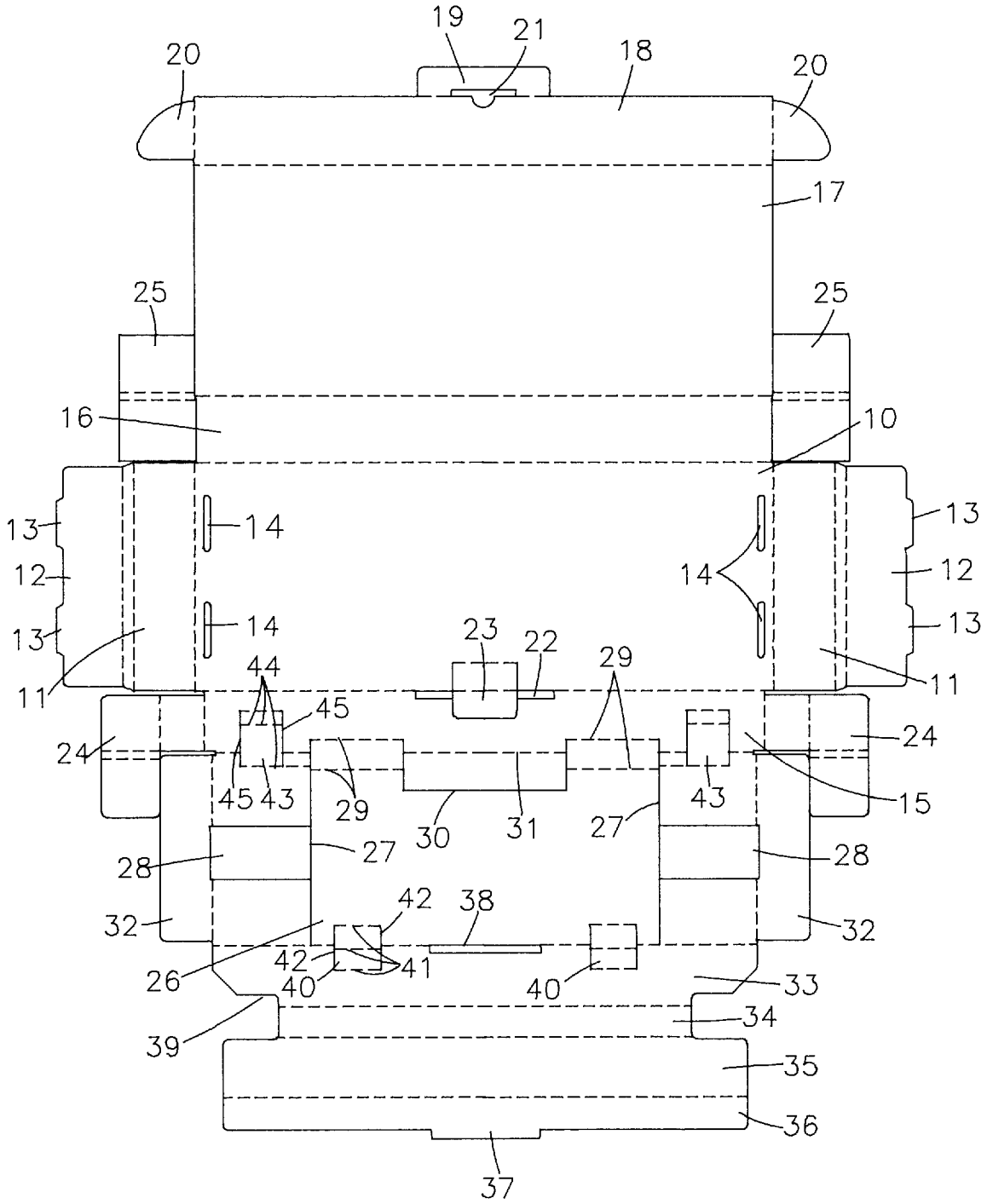
FIG. 2 is the plain developed view of the subject invention.

Referring to FIG. 2 which is a plain developed view, the subject invention relates to the providing of a configurational improvement of keyboard packaging box; said keyboard box comprising of a single sheet of cardboard that is cut and folded to shape; comprising a rectangular bottom 10; to the left and right short ends of the bottom 10 are respectively a first side plate 11; on the other end opposite the first side plate 11 is a second side plate 12; on the second side plate 12 are two side inserts 13; and at appropriate locations on the bottom 10 are corresponding two side insert grooves 14. The two opposite long sides of the bottom 10 are adjoined by a front plate 15 and a rear plate 16; the other side of the rear plate 16 extending to form a top 17 of a same size as the top 17; the other side of said top 17 continues to extend to form a front edge 18; at the middle section and on the two ends of the front edge 18 are respectively a top insert 19 and wings 20; in the top insert 19 is a top insert groove 21; corresponding to the above, at the joint of the bottom 10 and the front plate 15 are a bottom insert groove 22 and a bottom insert 23; the two ends of the front plate 15 and the rear plate 16 are adjoined by foldable inner side plates 24 and 25 of an appropriate areas.

The other side of the front plate 15 is adjoined by a separating plate 26; at appropriate distances on the left and right sides of the separating plate 26 is respectively a partition line 27; outside the partition line 27 is a penetrating hole 28; inside the partition line 27 are two parallel folding lines 29; between the left and right folding lines 29 is a U-shaped partition line 30; inside the U-shaped partition line is a folding line 31; the two sides of the separating plate 26 are adjoined respectively by a vertical plate 32; one side of the partition plate 26; on one side of the separating plate 26 are arranged in sequential order a first long plate 33, a second long plate 34, a third long plate 35 and a fourth long plate 36; on the other side of the fourth long plate 36 is a rear insert 37; between the separating plate 26 and the first long plate 33 is a corresponding rear insert groove 38; on two sides of the first long plate 33 and the second long plate 34 is a line pulling hole 39. Between the separating plate 26 and the first long plate 33 are two positioning plates 40; on said positioning plates 40 are three parallel folding lines 41; on two sides of the three folding lines 41 are partition lines 42; between the separating plate 26 and the front plate 15 are also two positioning plates 43; on said positioning plates 43 are also three parallel folding lines 44; the two ends of the three folding lines are connected with the partition line 45.

Figure 3:
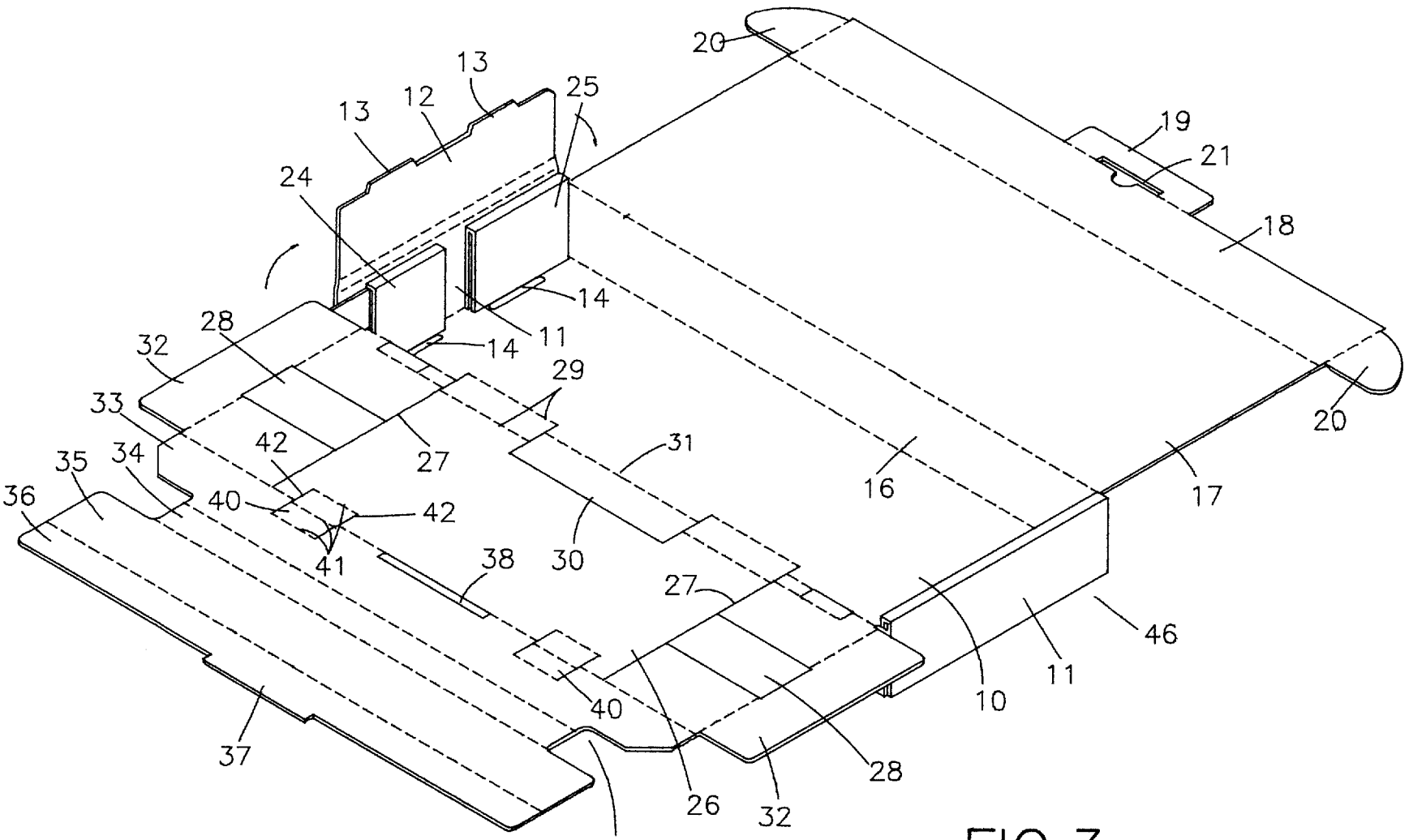
FIG. 3 is the perspective view of the subject invention with its side walls folded.
Figure 4:
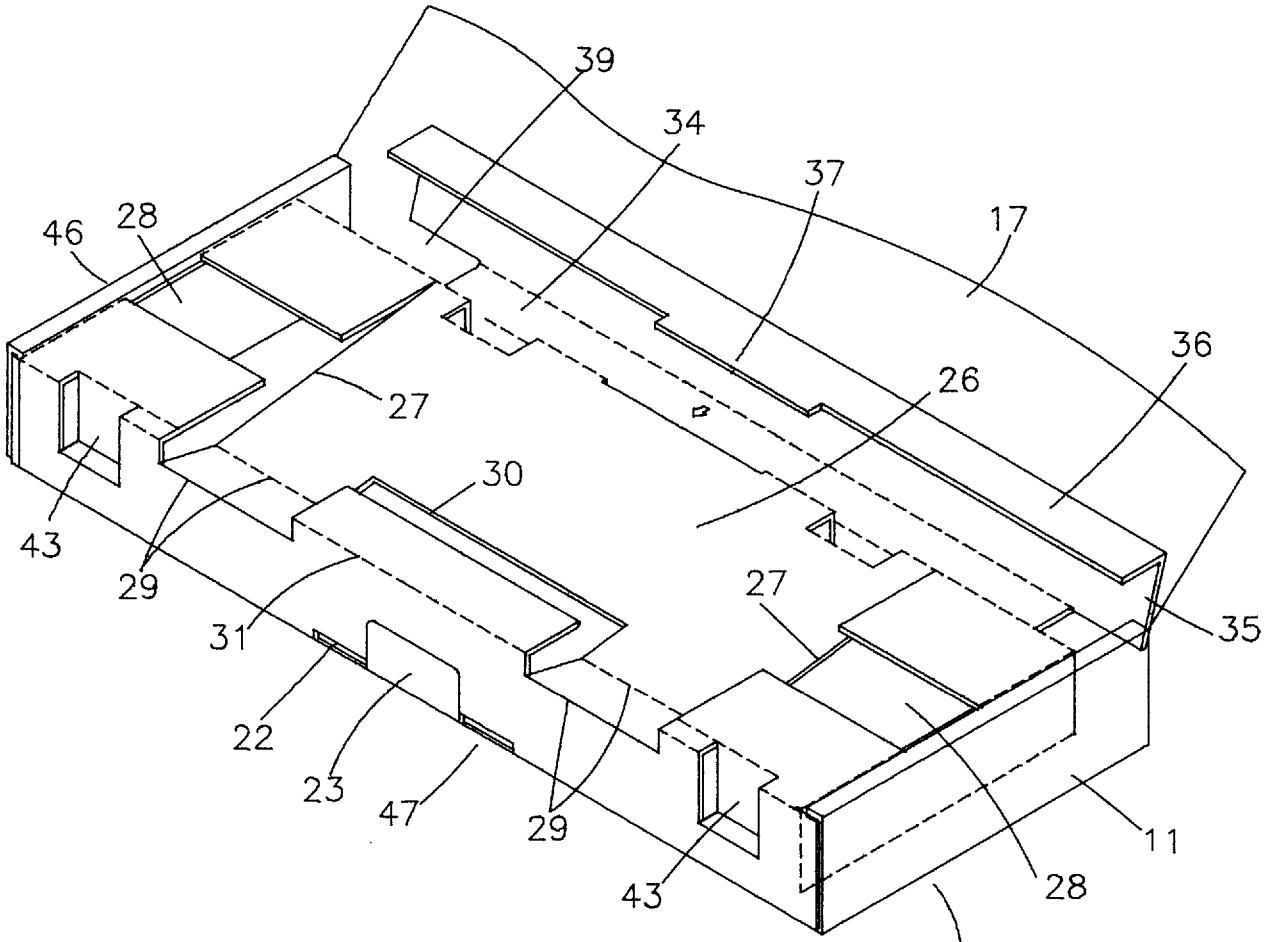
FIG. 4 is the perspective view of the subject invention with its base folded.
Figure 5:
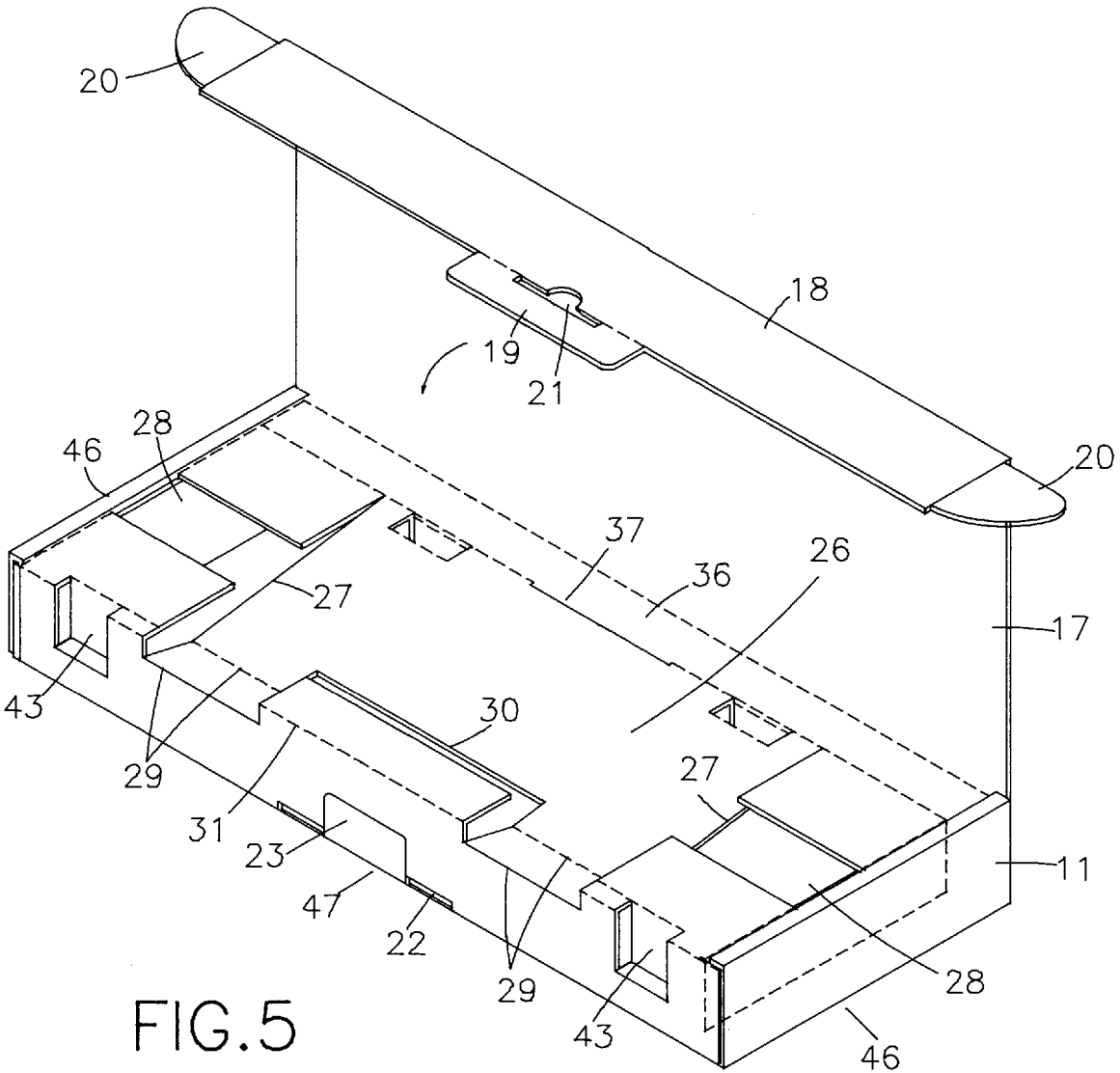
FIG. 5 is the perspective view of the subject invention.
Figure 6:
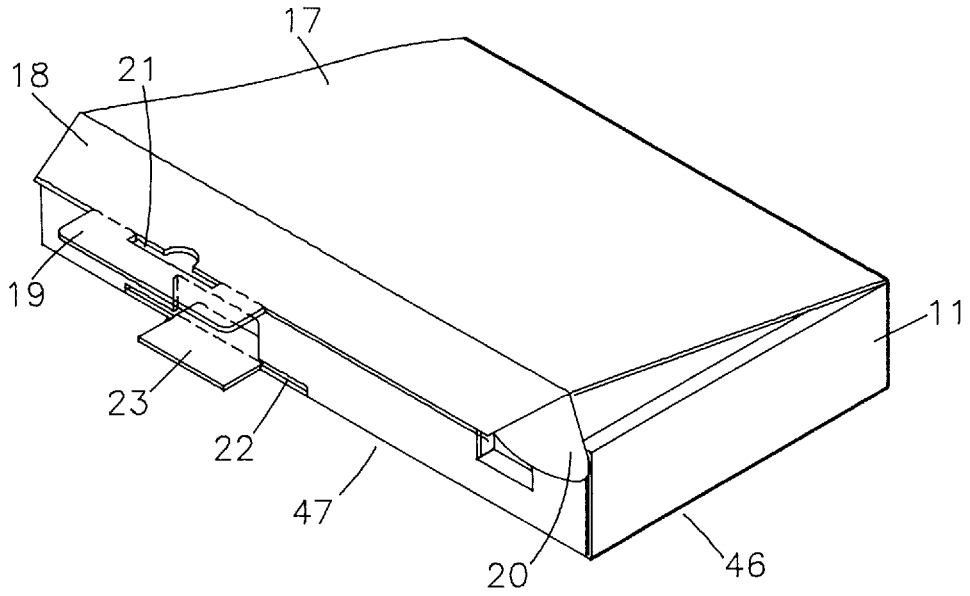
FIG. 6 is the perspective view of the subject invention with its top ajar.
Figure 7:
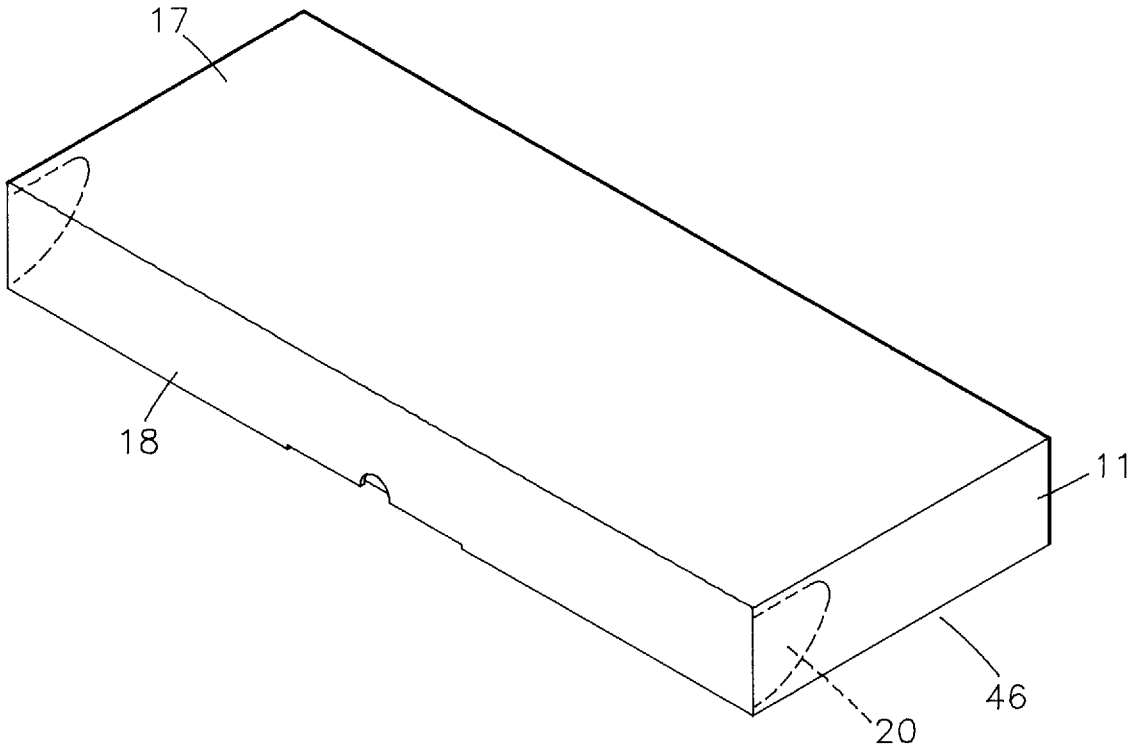
FIG. 7 is the perspective view of the subject invention with its top fully covered.
Figure 8:
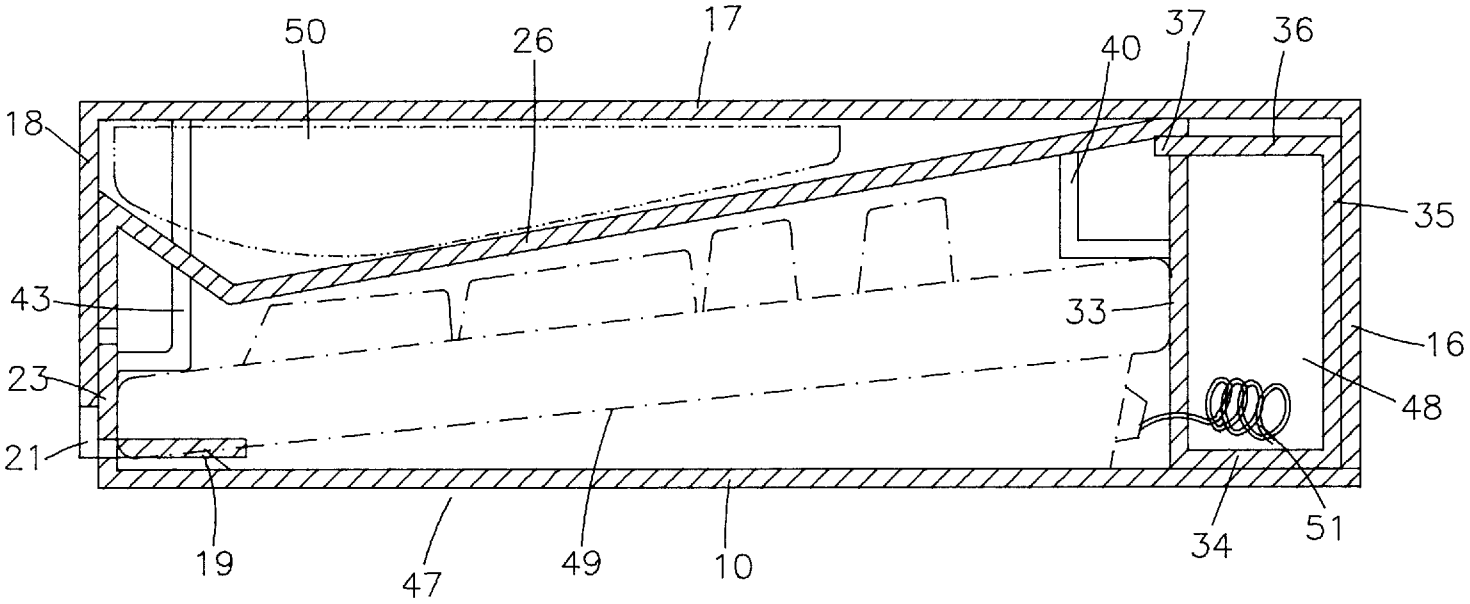
FIG. 8 is the sectional view of the subject invention with its keyboard and armrest in place.

The bending and folding assembly of the subject invention is illustrated in FIGS. 3 to 7, first, the front plate 15 and the rear plate 16 are folded up to be vertical to the bottom 10 (as shown in FIG. 3); the inside plates 24 and 25 on two sides of the front plate 15 and the rear plate 16 are also folded; then the second side plate 12 is folded to the first side plate 11; and the inner side plates 24 and 25 are enclosed in between the first side plate 11 and the second side plate 12; the two side inserts 13 at one side of the second side plate are inserted to corresponding side insert groove 14; thus the first side plate 11, the second side plate 12 and the inner side plates 24 and 25 have composed a sturdy side 46; while the bottom 10, the front plate 15, the rear plate 16 and the two sides 46 have composed a bottom box 47; then, the separating plate 26 is folded inward to the bottom box 47; and the partition line 27, the folding line 29 and the partition line 30 will enable the separating plate 26 to gradually incline upward from its center part (as shown in FIG. 4); and the two vertical plates 32 are folded to become vertical to the separating plate 26, to lean flatly on the second side plate 12, the first long plate 33, the second long plate 34, the third long plate 35 and the fourth long plate 36 to fold and form a square and elongated tube-shaped accommodating chamber 48, which is positioned at the connection corner of the bottom 10 and the rear plate 16; the rear insert 37 is inserted to its corresponding rear insert groove 38; so that the first long plate 33, the second long plate 34, the third long plate 35 and the fourth long plate 36 are folded and the accommodating chamber 48 is securely assembled (as illustrated in FIGS. 5 and 8); with the erection of the vertical plate 32, the separating plate 26 is securely supported to incline and reserve an appropriate space between the separating plate 26 and the bottom 10; besides, the positioning plates 40, 43 can be folded on the folding lines 41, 44 and the partition lines 42, 45 to an L shape protruding from the two sides on the bottom of the separating plate 26; the top 17 may be folded to the bottom box 47, to cover the top of the bottom box 47; the front edge 18 and the top insert 19 and wing 20 on one side of the top 17 can be properly folded, so that the top insert 19 is inserted in the bottom insert groove 22 (as shown in FIGS. 6 and 8) when the top 17 is covered; then, the bottom insert 23 is inserted in the top insert groove 21; by way of interlocking of the top insert 19 with the bottom insert grove 22 and the bottom insert 23 with the top insert groove 21, the top 17 can be securely covered on top of the bottom box 47; besides, the two wings 20 are inserted in the inside of the first side plate 11 (as in FIG. 7), so that the top 17 and the bottom box 47 are more securely assembled.

Referring to FIG. 8 which is the perspective view of the sectional view of the subject invention with its keyboard and armrest in place, the keyboard 49 may be accommodated below the separating plate 26, between the separating plate 26 and the bottom 10, and is securely positioned by the positioning plates 40 and 43; the armrest 50 can be accommodated above the separating plate 26, between the separating plate 26 and the top 17; while the two ends of the armrest 50 may be inserted along the partition line 27 into the bottom of the two sides of the separating plate 26, to enable secure positioning of the armrest 50; the connecting line 51 of the keyboard 49 is pulled through the line pulling hole 39 into the accommodating chamber 48; by so special design in the subject invention, the integral structural strength is increased, and the tensile strength is upgraded to effectively achieve the purpose of protecting the keyboard; furthermore, by convenient folding and assembling, the keyboard 49 and the armrest 50 can be simultaneously accommodated; such convenient positioning and removal will facilitate easy handling or transportation of the keyboard.

Summing up, the subject invention of "improvement on conventional keyboard packaging box" is indeed an unprecedented improvement on such weaknesses as weak structural strength and poor tensile strength in conventional keyboard packages; with its inventive step and originality that will full satisfy the qualifications for a patent right; hence this application is filed in accordance with the Patent Law to protect the subject inventor's rights and interests. Your favorable consideration should be appreciated.

It is hereby declared that the above description, covering merely the preferred embodiment, should not be based to limit or restrict the subject claim, and that all equivalent structural and/or configured variations and/or modifications made by anyone skilled in the subject trade, deriving from the subject description with drawings and contents therein, should reasonably be included in the intent of the subject invention and the subject claim.

We claim:

1. A integral cardboard blank for keyboard packaging box, comprising:

a. a longitudinally extended bottom plate having a pair of side insert grooves disposed adjacent opposing longitudinal ends thereof;

b. a pair of first side plates respectively joined to said opposing longitudinal ends of said bottom plate by respective fold lines;

c. a pair of second side plates respectively joined to said pair of first side plates by respective fold lines, each of said pair of second side plates having a pair of side inserts formed on a distal edge thereof for coupling with a respective pair of said side insert grooves subsequent to folding said first and second side plates;

d. a rear plate having a first longitudinally extended side joined to a first longitudinally extended side of said bottom plate by a fold line;

e. a top portion having a first longitudinally extended side joined to a second longitudinally extended side of said rear plate by a fold line;

f. a front edge portion having a first longitudinally extended side joined to a second longitudinally extended side of said top portion by a fold line, said front edge portion having a top insert formed centrally on a second longitudinally extended side thereof, said top insert having a top insert groove formed therein;

g. a pair of first inner side plates respectively joined to opposing longitudinal ends of said rear plate by respective fold lines;

h. a front plate having a first longitudinally extended side joined to a second longitudinally extended side of said bottom plate by a fold line;

i. a pair of second inner side plates respectively joined to opposing longitudinal ends of said front plate by respective fold lines;

j. a separating plate having a first longitudinally extended side joined to a second longitudinally extended side of said front plate by a fold line;

k. a pair of vertical plates respectively joined to opposing longitudinal ends of said separating plate by respective fold lines;

l. a long plate portion having a first longitudinally extended side joined to a second longitudinally extended side of said separating plate by a fold line, said long plate portion having a rear insert formed on a second longitudinally extended side thereof in correspondence with said top insert groove, said long plate portion having a plurality of longitudinally directed fold lines for defining a plurality of long plates; and, m. a pair of positioning plates formed from and bridging between said separating plate and said long plate portion, each of said positioning plates being joined on one end thereof to said separating plate by one fold line and joined on an opposing end to said long plate portion by another fold line.

2. The integral cardboard blank as recited in claim 1 further comprising a pair of wings respectively joined to opposing longitudinal ends of said front edge portion by a pair of respective fold lines.

* * * * *